United States Patent [19]

Lumpkin

[11] Patent Number: 4,823,724

[45] Date of Patent: Apr. 25, 1989

[54] BUMPER STORAGE SYSTEM

[75] Inventor: Anthony P. Lumpkin, Fond du Lac, Wis.

[73] Assignee: Brunswick Corporation, Skokie, Ill.

[21] Appl. No.: 156,701

[22] Filed: Feb. 17, 1988

[51] Int. Cl.[4] ..... B63B 59/02

[52] U.S. Cl. ..... 114/343; 114/364; 114/219

[58] Field of Search ..... 114/219, 220, 343, 364, 114/190; 441/80, 81, 84; 405/212–215

[56] References Cited

U.S. PATENT DOCUMENTS 4,526,124 7/1985 Hartwall ..... 114/219

FOREIGN PATENT DOCUMENTS 3332733 3/1985 Fed. Rep. of Germany ..... 114/219

*Primary Examiner*—Sherman D. Basinger

*Attorney, Agent, or Firm*—Donald Cayen

[57] ABSTRACT

A bumper storage system is useful for selectively stowing the bumpers that are commonly used to protect boats against damage from a dock or the like and for automatically setting the bumpers in their operative protective positions. The bumper storage system comprises a receptacle on the boat that loosely receives a bumper, with one bumper end being readily accessible to a person on board. The second bumper end is tied by a tether to a fitting within the receptacle. The tether is exactly the right length for suspending the bumper in the proper operative position when the bumper is removed from the receptacle and tossed over the deck and alongside the hull. The receptacle may be of different types, including being formed as a cavity molded into the boat hull or deck. Other types of receptacles can be inserted into a boat hull or attached to a cockpit wall.

25 Claims, 2 Drawing Sheets

BUMPER STORAGE SYSTEM

BACKGROUND OF THE INVENTION

1. Field of the Invention

This invention pertains to protection devices, and more particularly to apparatus for protecting a marine vessel against hull damage.

2. Description of the Prior Art

It is well known to use bumpers or fenders of various types to prevent damage to boat hulls from docks or other boats tied alongside. The bumpers are typically suspended against the hull by short lines tied to cleats or a rail in a position to cushion boat contact with the dock or other boats. When underway, the bumpers are usually pulled up from alongside the hull.

From that point, the practice among skippers diverges. Some skippers choose to leave the bumper lines tied to the cleats or rail when underway, with the bumpers lying on the deck or in the cockpit. However, passengers and crew are then likely to trip over the bumpers and lines. Bumpers in the cockpit take up space, and they can swing about in rough weather.

The preferred practice is to untie the bumper lines from the cleats or rail and to stow the bumpers and lines in an out of the way location. Upon redocking, the bumpers are retrieved from the stowed location, the lines are retied to the cleats, and the bumpers are tossed over the deck to hang alongside the hull.

Proper bumper placement at docking is a very important task that requires considerable skill. The bumpers must be located at the proper fore and aft locations along the hull. They must also be positioned at the proper height above the water level. The knots must be tied securely to the cleats or rail and at the right spots on the lines. In short, properly setting the bumpers while a boat is being docked constitutes a time consuming and distracting chore, even in calm conditions. When docking in high winds or stormy weather, quickly and properly setting the bumpers becomes crucial. The skipper may be required to exercise skillful seamanship to maneuver his boat to avoid hull and gear damage and even personal injury if he must wait for the crew to set the bumpers. If experienced crew is not aboard, the problem is greatly aggravated, and the situation can potentially become dangerous.

Thus, a need exists for improved apparatus for cushioning a boat hull against a dock or other structure.

SUMMARY OF THE INVENTION

In accordance with the present invention, a bumper storage system is provided that permits rapid and precise bumper setting even by inexperienced crew and under adverse conditions. This is accomplished by apparatus that includes a storage receptacle fixed to the boat hull and a tether of predetermined length for permanently joining the bumper to the receptacle.

The storage receptacle may be a canister or tube having an interior sized to loosely receive one of the bumpers used on a particular boat. The tube length is approximately equal to the bumper length. One end of the tube is closed. When the bumper is placed into the tube open end, the bumper exposed end is easily accessible from the tube open end. One or more tubes are mounted in a vertical orientation to the boat hull in the proper fore and aft locations for protecting the hull against damage from a dock or other boats. The tubes may be installed in holes cut into the boat deck near the gunwales. Attachment between the tubes and hull may be by various types of flanges that suit the particular boat design and the receptacle location. In some boat designs, the bumper receptacles may be molded as cavities directly into the hull, thereby eliminating the need for separate tubular components. In a modified embodiment, the storage receptacle is made as an elongated longitudinally open cover having a hollow portion that is closed at one end with a floor. The hollow portion mounts against a flat wall on the boat by means of opposed longitudinally extending flanges, such that the hollow portion cooperates with the boat wall to form an open ended receptacle.

An eye-like fitting is securely fastened to the inside of the receptacle, preferably at the closed end. With cavities molded directly into the boat hull, the eyes are fastened to the hull itself at the bottom of the cavities.

One end of a flexible line is tied to the eye fitting of each receptacle. The line second end is tied to one end of a bumper. The length of the line between the fitting and bumper is carefully chosen such that when the line is fully stretched the bumper is properly placed alongside the boat hull to protect it against a dock or similar structure. Thus, the line serves as a tether of predetermined and constant length for properly setting the bumper. When stowed in a receptacle, the bumper and tether are conveniently and safely out of the way, yet the bumper is readily accessible on short notice for retrieval and flipping over the gunwale alongside the hull. The permanent and correct length provided by the tethers enables the boat bumpers to be automatically and repeatedly set at the correct positions without difficulty by even the most inexperienced persons and in all types of weather.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
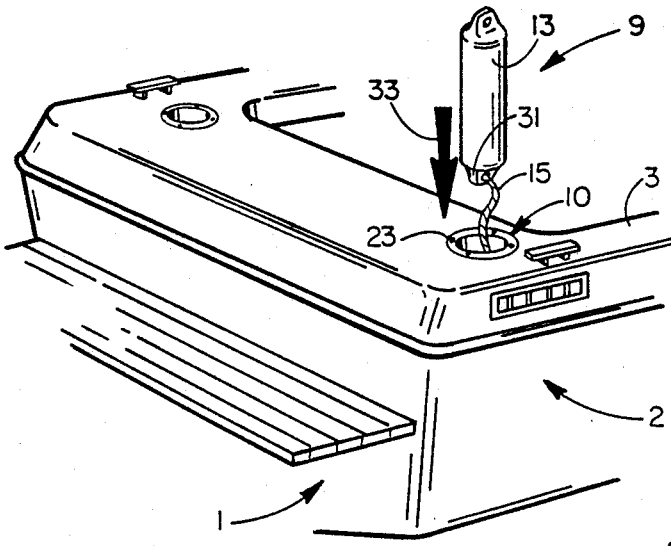
FIG. 1 is a perspective view of a portion of a boat that employs the present invention.
Figure 2:
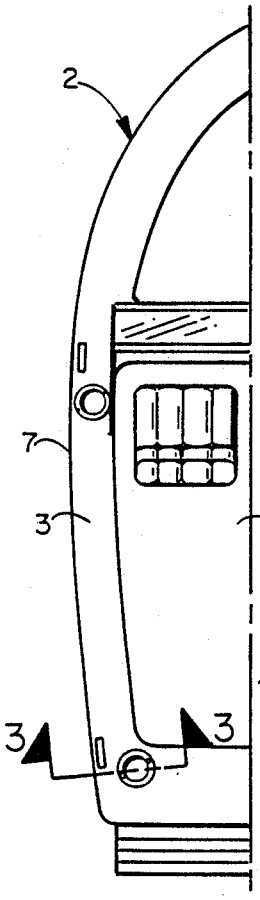
FIG. 2 is a top view of a portion of a boat that employs the present invention.

Referring to FIGS. 1 and 2, a portion of a boat 1 is illustrated that includes the present invention. The boat shown is merely representative of a wide variety of marine vessels, both power and sail, that are used for pleasure and commercial use. Thus, it will be understood that the present invention is not limited to any particular type of boat. The particular boat 1 is shown with a hull 2 that includes a deck 3, a cockpit 5, and a gunwale 7.

Figure 3:
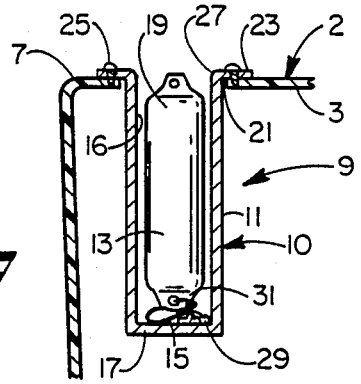
FIG. 3 is an enlarged cross sectional view taken along lines 3—3 of FIG. 2 showing the bumper in the stowed position.
Figure 4:
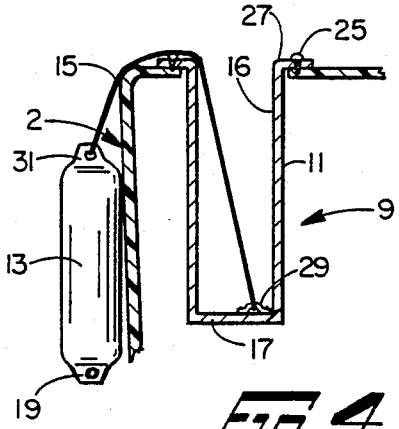
FIG. 4 is a view similar to FIG. 3, but showing the bumper in the operative position.

In accordance with the present invention, a bumper storage system 9 is incorporated into the boat hull 2. Looking also at FIGS. 3 and 4, the bumper storage system 9 comprises a storage receptacle 10, a bumper or fender 13, and a tether 15 connecting the bumper to the receptacle. The bumper 13 may be of any conventional type, as is well known. The receptacle 10 may be in the form of a canister or tube 11, and it is preferably constructed as a thin walled hollow cylinder, although other cross sectional shapes are also acceptable. The tube 11 has a length that is approximately equal to the overall length of the bumper. The tube interior surface 16 has a diameter large enough to loosely receive the bumper. One end of the tube is closed with a floor 17. Thus, when the bumper is inserted into the tube, one end 19 of the bumper is exposed at the tube open end.

The tube 11 is installed in a vertical attitude within the boat hull 2 through a hole 21 in the deck 3. To secure the tube to the deck, the tube may be fabricated with an annular flange 23, which is mounted to the deck by conventional corrosion resistant fasteners 25. The exterior corner 27 between the flange 23 and the tube interior surface 16 has a large radius.

To the tube floor 17 is fastened an eye-like fitting 29. One end of the tether 15 is securely tied to the eye 29. The other end of the tether is securely tied to the second end 31 of the bumper 13. The tether length is chosen such that when the bumper is removed from the tube 11 and suspended alongside the boat hull 2, the bumper is in an operative position to properly protect the hull against a dock or other large structure, not shown. To stow the bumper and tether, the bumper second end 31 is inserted first into the tube, as is indicated by arrow 33 in FIG. 1. When in the stowed position of FIG. 3, the bumper is safely and neatly out of the way, but the tether remains tied to the bumper and the tube. Therefore, when necessary, a person need merely grab the exposed end 19 of the bumper and flip it over the gunwale 7 to automatically and properly set the bumper in the operative position.

As many bumper storage systems 9 as are required for the particular boat 1 may be installed. The optimum location for the bumper storage systems will vary among boats, and the present invention is sufficiently versatile to permit placement of the tubes 11 at almost any desired location on the boat.

Figure 6:
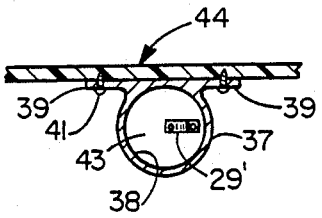
FIG. 6 is a cross sectional view taken along lines 6—6 of FIG. 5, but showing the bumper removed from the storage receptacle.
Figure 5:
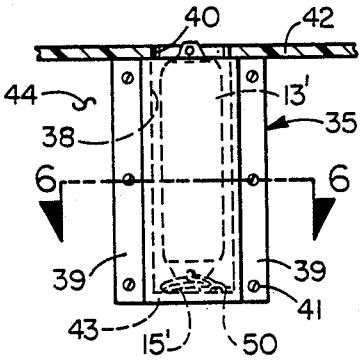
FIG. 5 is a side view, partially in section, of a modified embodiment of the present invention.

Turning to FIGS. 5 and 6, a modified bumper storage receptacle 35 is shown. The modified receptacle 35 comprises a tubular portion 37 with oppositely extending longitudinal flanges 39 joined to the tubular portion. The tubular portion 37 has an interior surface 38 sized to loosely receive a bumper 13' in the same manner as the tube 11 described previously with respect to FIGS. 3 and 4. The interior surface 38 of receptacle 35 is aligned with a hole 40 that passes through the boat deck 42. A receptacle 35 is mounted to the inside of the boat hull 44 in a vertical attitude by fasteners 41. The receptacle bottom end is closed with a floor 43, to which is fastened an eye fitting 50. A tether 15' is tied at one end thereof to the eye 50 and at the other end to the bumper 13'. Thus, the receptacle 35, bumper 13', and tether 15' of FIGS. 5 and 6 function in a manner identical to the bumper storage system described in conjunction with FIGS. 1–4.

Figure 7:
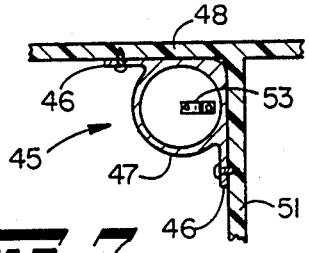
FIG. 7 is a cross sectional view similar to FIG. 6, but showing a transverse cross sectional view of a further modified receptacle according to the present invention.

In FIG. 7, a further modified receptacle 45 is illustrated. The receptacle 45 is generally similar to the receptacle 35 of FIGS. 5 and 6, but receptacle 45 is fabricated with flanges 46 that extend at generally right angles to each other. The flanges 46 are designed to be fastened to a portion of a boat hull 48 and an interior bulkhead 51. Like the receptacle 35, the receptacle 45 is manufactured with a tubular section 47, to the closed bottom end 49 of which is fastened an eye fitting 53. One end of a tether, not illustrated in FIG. 7, is tied to the eye 53, and the other end of the tether is tied to a bumper, also not shown, in the same manner as described previously with respect to FIGS. 1–6.

Figure 8:
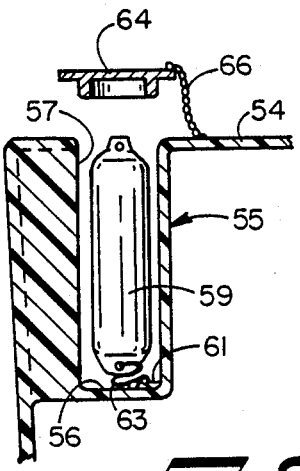
FIG. 8 is a vertical cross sectional view of a portion of a boat hull showing a further embodiment of the present invention.

Referring to FIG. 8, reference numeral 55 represents a boat hull that is suitable for having a receptacle molded directly into the hull in the form of a cavity 57 that opens onto the deck 54. Examples of such hull constructions may be bass fishing boats with raised bow platforms. The cross sectional size and shape and the length of the cavity 57 are chosen to accept a bumper 59 in a manner similar to the receptacles 10, 35, and 45 previously described. An eye fitting 61 is fastened directly to the hull 55 at the cavity floor 56. A tether 63 of predetermined length for the particular boat is tied to the bumper 59 and eye 61 as previously explained. To keep the cavity 57 dry and to provide a neat appearance to the deck 54, a removable cap 64 may be employed. The cap 64 is designed to snuggly fit within the cavity. A chain 66 may be used to prevent loss of the cap. It will be appreciated, of course, that a cap similar to the one shown in FIG. 8 can be used in combination with any of the receptacles described in conjunction with the boat storage system of the present invention.

Figure 9:
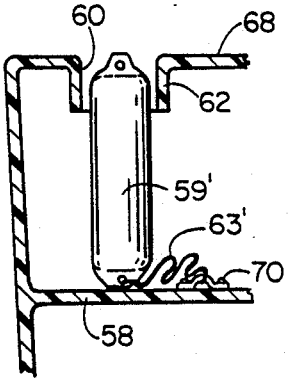
FIG. 9 is a view similar to FIG. 8, but showing a modified construction of a boat hull that employs the present invention.

It is not necessary that the cavity 57 of FIG. 8 be fully enclosed between the deck 54 and the cavity floor 56. Turning to FIG. 9, a modified cavity 60 in a deck 68 has a relatively short guide tube 62 for guiding the upper end of the bumper 59,. The floor 58 of the boat hull serves as the stop for locating the bumper 59, An eye fitting 70 is fastened directly to the hull floor 58, and a tether 63, connects the bumper 59, to the fitting 70.

Figure 10:
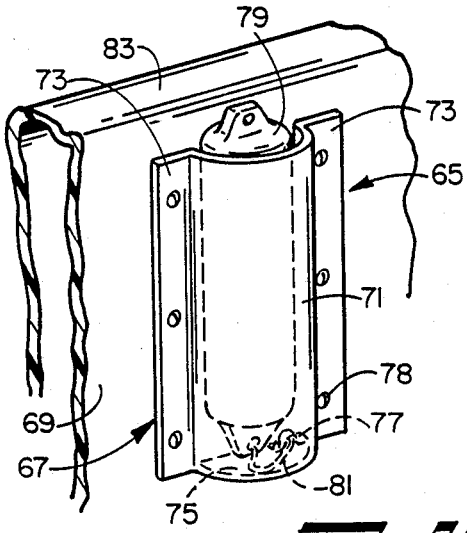
FIG. 10 is a perspective view of another embodiment of the present invention.

It is a feature of the present invention that the bumper storage system need not include a bumper receptacle that is mounted internally within a boat hull. Looking at FIG. 10, a storage system 65 is depicted that includes an open cover 67 that is secured to an exterior wall 69 of the boat, as, for example, to a cockpit wall. The cover 67 has an elongated hollow portion 71, which may be generally semi-cylindrical in cross section. Oppositely extending longitudinal flanges 73 are joined to the hollow portion 71. The lower end of the hollow portion is closed with a floor 75, to which is fastened an eye fitting 77. The hollow portion 71 is sized such that when the cover is fastened to the wall 69 with fasteners 78, the hollow portion and wall cooperate to form a receptacle for receiving and stowing a bumper 79. A tether 81, as previously described, is tied to the bumper 79 and the fitting 77. In operation, as with the other embodiments of the present invention described herein, the bumper 79 is pulled from the receptacle and tossed over the deck 83, and the bumper is automatically and properly located against the boat hull by the correct length tether 81.

Thus, it is apparent that there has been provided, in accordance with the invention, a bumper storage system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A bumper storage system for a marine vessel having a hull comprising:

a. an elongated bumper adapted to cushion the vessel against a dock or the like;

b. receptacle means recessible into the vessel hull for removeably receiving the bumper; and c. tether means tied to the receptacle means for suspending the bumper alongside the vessel at a proper location to protect the vessel from the dock or the like, so that when the receptacle means is recessed into the vessel hull the bumper may be selectively stowed unobtrusively within the hull and placed in an operative position wherein it is protectively located by the tether means between the vessel and the dock.

2. The bumper storage system of claim 1 wherein the receptacle means comprises:

a. an elongated tubular portion having a length approximately equal to the length of the bumper and an interior sized to loosely receive the bumper, the tubular portion being recessible into and attachable to the vessel hull in a vertical attitude to thereby create top and bottom ends; and b. a floor joined to the bottom end of the tubular portion, so that the tubular portion floor locates the bumper stowed in the tubular portion such that one end of the bumper is readily accessible for removing the bumper from the tubular portion.

3. The bumper storage system of claim 2 wherein the receptacle means further comprises:

a. at least one elongated flange extending longitudinally along and projecting outwardly from the tubular portion and contactable with the vessel hull; and b. fastener means for attaching the flange to the vessel hull, so that the receptacle means is attachable to the hull by means of the flange.

4. The bumper storage system of claim 3, wherein there are two oppositely extending and outwardly projecting elongated flanges extending along the tubular portion for attaching the receptacle means to the vessel hull.

5. The bumper storage system of claim 3 wherein there are two elongated flanges integral with and extending along and projecting outwardly from the tubular portion for attaching the receptacle means to the vessel hull, the flanges being generally at right angles to each other.

6. A bumper storage system for marine vessels comprising:

a. an elongated bumper adapted to cushion the vessel against a dock or the like;

b. receptacle means attachable to the vessel for removeably receiving the bumper wherein the receptacle means comprises:

i. an elongated tubular portion having a length approximately equal to the length of the bumper and an interior sized to loosely receive the bumper, the tubular portion being attachable to the vessel in a vertical attitude to thereby create top and bottom ends;

ii. a floor joined to the bottom end of the tubular portion; and iii. an annular flange joined to the top end of the tubular portion and adapted to be attached to the vessel, so that when the receptacle means is attached to the vessel the bumper and tether may be selectively stowed in the receptacle means and placed in an operative position wherein it is protectively located by the tether means between the vessel and the dock.

7. A bumper storage system comprising:

a. an elongated bumper adapter to cushion the vessel against a dock or the like;

b. receptacle means attachable to the vessel for removeably receiving the bumper, the receptacle means comprising:

i. an elongated tubular portion having a length approximately equal to the length of the bumper and an interior sized to loosely receive the bumper, the tubular portion being attachable to the vessel in a vertical attitude to thereby create top and bottom ends; and ii. a floor joined to the bottom end of the tubular portion;

c. tether means tied to the receptacle means for suspending the bumper alongside the vessel at a proper location to protect the vessel from the dock or the like; and d. cap means for removeably covering the top end of the receptacle tubular portion, so that when the receptacle means is attached to the vessel the bumper and tether may be selectively stowed in the receptacle means and placed in an operative position wherein it is protectively located by the tether means between the vessel and the dock.

8. The bumper storage system of claim 1 wherein the tether means comprises a flexible line of predetermined length and having first and second ends, the first end being tied to the bumper and the second end being tied solely to the receptacle means, so that the line second end is in a recessed and unobtrusive location with the boat hull.

9. A bumper storage system comprising:

a. an elongated bumper adapted to cushion the vessel against a dock or the like;

b. receptacle means attachable to the vessel for removeably receiving the bumper, the receptacle means comprising:

i. an elongated tubular portion having a length approximately equal to the length of the bumper and an interior sized to loosely receive the bumper, the tubular portion being attachable to the vessel in a vertical attitude to thereby create top and bottom ends; and ii. a floor joined to the bottom end of the tubular portion; and c. tether means tied to the receptacle means for suspending the bumper alongside the vessel at a proper location to protect the vessel from the dock or the like, wherein the tether means comprises:

i. a flexible tether of predetermined length having a first end tied to the bumper; and ii. fitting means attached to the floor of the tubular portion for having the tether second end tied thereto, so that the bumper is automatically locatable in the operative position by the tether.

10. A bumper storage system for marine vessels comprising:

a. an elongated bumper adapted to cushion the vessel against a dock or the like;

b. receptacle means attachable to the vessel for removeably receiving the bumper, wherein the receptacle means comprises:

i. an elongated longitudinally open cover having a hollow portion with a length approximately equal to the length of the bumper;

ii. a pair of elongated flanges joined to and oppositely extending from the hollow portion, the flanges being attachable to the vessel in a generally vertical orientation to create top and bottom ends on the hollow portion, the hollow portion and the vessel cooperating to form a receptacle sized to loosely accept the bumper; and iii. a floor joined to the hollow portion bottom end; and c. tether means tied to the receptacle means for suspending the bumper alongside the vessel at a proper location to protect the vessel from the dock or the like, so that the floor locates the bumper stowed in the receptacle such that one end of the bumper is readily accessible for removing the bumper from the receptable.

11. The bumper storage system of claim 10 wherein the tether means comprises:

a. a flexible tether of predetermined length having a first end tied to the bumper; and b. fitting means attached to the floor of the hollow portion for having the tether second end tied thereto, so that the bumper is automatically locatable in the operative position by the tether.

12. In combination with a boat having a hull and a deck, the improvement comprising a bumper storage system for protecting the boat hull against damage from a dock or the like, wherein:

a. the vessel deck defines a hole therethrough; and b. the bumper storage system comprises:

i. an elongated bumper adapted to cushion the boat hull against the dock or the like;

ii. receptacle means attached to the boat hull and aligned with the hole in the deck for removeably receiving the bumper; and iii. tether means tied to the receptacle means for properly suspending the bumper alongside the boat hull to protect the hull from the dock or the like, so that the bumper and tether may be selectively stowed in the receptacle means and placed in an operative position wherein it is protectively located by the tether means between the hull and the dock.

13. The improvement of claim 12 wherein the receptacle means comprises:

a. an elongated tubular portion having a length approximately equal to the length of the bumper and an interior sized to loosely receive the bumper, the tubular portion being attached to the boat in a generally vertical attitude to thereby create top and bottom ends, the tubular portion top end being adjacent the hole in the deck; and b. a floor joined to the bottom end of the tubular portion, so that the tubular portion floor locates the bumper stowed in the tubular portion such that one end of the bumper is readily accessible for removing the bumper from the tubular portion.

14. The improvement of claim 13 wherein:

a. the tubular portion extends through the hole in the deck; and b. the tubular portion is formed with an annular flange at the top end thereof, the annular flange being in facing contact with the deck to enable the tubular portion to be attached to the deck by means of the flange.

15. The improvement of claim 13 wherein the receptacle means further comprises:

a. a pair of flanges extending longitudinally along the tubular portion and oppositely from each other; and b. fastener means for attaching the flanges to the boat hull.

16. The improvement of claim 13 wherein the receptacle means further comprises:

a. a pair of flanges extending longitudinally along the tubular portion and generally at right angles to each other; and b. fastener means for attaching the flanges to the boat hull.

17. The improvement of claim 13 wherein the tether means comprises:

a. a flexible tether of predetermined length having a first end tied to the bumper; and b. fitting means attached to the floor of the tubular portion for having the tether second end tied thereto, so that the bumper is automatically locatable in the operative condition by the tether.

18. The improvement of claim 12 further comprising cap means for removeably covering the hole in the deck and the receptacle means aligned therewith.

19. In combination with a boat having a hull and a vertical wall, the improvement comprising a bumper storage system for protecting the boat hull against damage from a dock or the like comprising:

a. an elongated bumper adapted to cushion the boat hull against the dock;

b. a receptacle comprising:

i. an elongated cover having a longitudinally open hollow portion with a length approximately equal to the length of the bumper;

ii. a pair of flanges joined to and oppositely extending from the hollow portion, the flanges being attached to the boat vertical wall in a generally vertical attitude to create top and bottom ends of the hollow portion, the hollow portion and the boat wall cooperating to form an opening sized to loosely accept the bumper; and iii. a floor joined to the hollow portion bottom end; and c. tether means tied to the receptacle floor for suspending the bumper alongside the boat hull to protect the boat from the dock or the like, so that the bumper and tether means may be selectively stowed in the receptacle and placed in an operative position wherein the bumper is protectively located by the tether means between the boat hull and the dock.

20. A marine vessel comprising:

a. at least one bumper adapted to cushion the vessel against a dock or the like;

b. a hull having a deck that defines at least one vertically oriented cavity having an interior sized to stow the bumper, the cavity having a floor located to render a stowed bumper end readily accessible at the deck; and c. tether means tied to the cavity interior for protectively suspending the bumper alongside the vessel to protect it from the dock or the like.

21. The vessel of claim 20 wherein the tether means comprises a flexible line of predetermined length and having first and second ends, the first end being tied to the bumper and the second end being tied to the cavity interior.

22. A marine vessel comprising:

a. at least one bumper adapted to cushion the vessel against a dock or the like;

b. a hull having a deck that defines at least one vertically oriented cavity having an interior sized to stow the bumper, the cavity having a floor located to render a stowed bumper end readily accessible at the deck; and c. tether means tied to the cavity interior for protectively suspending the bumper alongside the vessel to protect it from the dock or the like, wherein the tether means comprises:

i. a flexible tether of predetermined length having a first end tied to the bumper; and ii. fitting means attached to the cavity floor for having the tether second end tied thereto, so that the bumper is automatically locatable in the operative condition by the tether attached to the cavity floor.

23. A marine vessel comprising:

a. at least one bumper adapted to cushion the vessel against a dock or the like;

b. a hull having a deck that defines at least one vertically oriented cavity having an interior sized to stow the bumper, the cavity having a floor located to render a stowed bumper end readily accessible at the deck;

c. tether means tied to the cavity interior for protectively suspending the bumper alongside the vessel to protect it from the dock or the like; and d. cap means for removeably covering the cavity.

24. A method of protecting a boat hull from damage from a dock or the like comprising the steps of:

a. providing at least one elongated bumper adapted to cushion the boat from the dock;

b. recessing an elongated receptacle having a closed bottom end and an open top end into the boat hull, the receptacle having a length approximately equal to the length of the bumper and having an interior sized to loosely receive the bumper; p1 c. tying the first end of a flexible tether to the receptacle;

d. pulling the tether taut and hanging the second end over the boat deck alongside the boat hull; and e. tying the bumper to the tether second end in an operative position at a location to set the bumper to protect the boat from the dock.

25. The method of claim 24 further comprising the steps of:

a. removing the bumper from outside the boat hull and inserting the bumper unobtrusively into the boat hull within the receptacle; and b. grasping the bumper and tossing the bumper over the boat deck to thereby suspend the bumper in the operative position for protecting the boat from the dock.

* * * * *